US010477312B2

(12) United States Patent
Pribyl et al.

(10) Patent No.: US 10,477,312 B2
(45) Date of Patent: Nov. 12, 2019

(54) EARPHONE WITH ACTIVE SUPPRESSION OF AMBIENT NOISE

(71) Applicant: AKG Acoustics GmbH, Vienna (AT)

(72) Inventors: Richard Pribyl, Fischamend (AT); Michael Perkmann, Vienna (AT); Hannes Lehdorfer, Vienna (AT)

(73) Assignee: AKG ACOUSTICS GMBH, Vienna (AT)

( * ) Notice: Subject to any disclaimer, the term of this patent is extended or adjusted under 35 U.S.C. 154(b) by 564 days.

(21) Appl. No.: 13/900,183

(22) Filed: May 22, 2013

(65) Prior Publication Data

US 2013/0315414 A1 Nov. 28, 2013

(30) Foreign Application Priority Data

May 25, 2012 (EP) ..... 12450032

(51) Int. Cl.
*H04R 3/02* (2006.01)
*H04R 1/10* (2006.01)

(52) U.S. Cl.
CPC ..... *H04R 3/02* (2013.01); *H04R 1/1083* (2013.01)

(58) Field of Classification Search
CPC ..... H04R 3/00; H04R 3/02; H04R 1/1075; H04R 1/1083
USPC ..... 381/71.1, 71.6, 71.7, 71.8, 74, 91, 92, 381/94.1, 95, 96, 113, 116, 121, 122, 381/312, 370
See application file for complete search history.

(56) References Cited

U.S. PATENT DOCUMENTS

| | | | | |
|---|---|---|---|---|
| 4,455,675 | A | 6/1984 | Bose et al. | |
| 4,494,074 | A | 1/1985 | Bose | |
| 5,182,774 | A | 1/1993 | Bourk | |
| 5,815,050 | A * | 9/1998 | Brooks | H03H 7/34 333/156 |
| 8,077,874 | B2 | 12/2011 | Sapiejewski | |
| 8,792,670 | B2 * | 7/2014 | Schoerkmaier | G10K 11/178 381/398 |
| 2005/0036646 | A1 * | 2/2005 | Garner | B60R 11/0217 381/412 |
| 2006/0104473 | A1 * | 5/2006 | Polfreman | C25D 9/06 381/424 |
| 2006/0133639 | A1 * | 6/2006 | Wu | H04R 7/125 381/426 |
| 2007/0154049 | A1 | 7/2007 | Levitsky et al. | |

(Continued)

FOREIGN PATENT DOCUMENTS

| | | |
|---|---|---|
| CN | 1344078 A | 4/2002 |
| CN | 1395211 A | 2/2003 |

(Continued)

OTHER PUBLICATIONS

Jeng, Response Identification in the Extremely Low Frequency, 2011.*

(Continued)

*Primary Examiner* — William A Jerez Lora
(74) *Attorney, Agent, or Firm* — Brooks Kushman P.C.

(57) ABSTRACT

An earphone is provided that can decrease a time delay between a microphone and a loudspeaker. The earphone includes a microphone incorporated with the membrane of loudspeaker. The loudspeaker and the microphone are connected by connection lines to an electronic circuit.

17 Claims, 2 Drawing Sheets

(56) References Cited

U.S. PATENT DOCUMENTS

| | | | | |
|---|---|---|---|---|
| 2009/0136055 | A1* | 5/2009 | Grell | H04R 1/1083 381/71.6 |
| 2010/0067731 | A1* | 3/2010 | De Haan | H04R 9/047 381/386 |
| 2011/0044465 | A1* | 2/2011 | D'Agostino et al. | G10K 11/178 381/71.6 |
| 2011/0170699 | A1* | 7/2011 | Schoerkmaier | G10K 11/178 381/71.1 |

FOREIGN PATENT DOCUMENTS

| | | | |
|---|---|---|---|
| DE | 3429147 | * | 2/1986 |
| DE | 3429147 | A1 | 2/1986 |
| EP | 1850632 | A2 | 10/2007 |

OTHER PUBLICATIONS

European Search Report for corresponding European Application No. 12450032.3, dated Oct. 17, 2012, 4 pages.

* cited by examiner

EARPHONE WITH ACTIVE SUPPRESSION OF AMBIENT NOISE

BACKGROUND OF THE INVENTION

1. Priority Claim

This application claims the benefit of priority from European Patent Application No. 12450032, filed May 25, 2012, which is incorporated by reference.

2. Technical Field

The present application relates to an earphone with suppression of ambient noise.

3. Related Art

An earphone may generally be used to play back music, speech, or both, or to play back a useful signal. In addition, an earphone may be configured to prevent or reduce the interfering effect of ambient noise. For example, some earphones provide a microphone at a location of the earphone. The microphone may receive interfering noise and, via a corresponding electronic circuit, transmit signals to generate phase-shifted counter-pulses on the loudspeaker of the earphone so that the interfering noises are suppressed in the ear.

In some earphones, a time delay of the sound between the microphone and loudspeaker may decrease the quality of noise suppression and the stability connected with the corresponding earphone structure. In these earphones a howling (resonance catastrophe) may result, thereby creating undesired positive feedback.

SUMMARY

An earphone is provided that can decrease a time delay between a microphone and a loudspeaker. The earphone includes a microphone incorporated with the membrane of loudspeaker. The loudspeaker and the microphone are connected by connection lines to an electronic circuit.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Loudspeaker systems that can decrease or eliminate time delay between a microphone and a loudspeaker are described. For example, the microphone, through which ambient noise may be detected for further processing and consideration for the loudspeaker, may be formed directly on the membrane or the diaphragm of the loudspeaker of the earphone shell.

In order not to interfere with the quality of the loudspeaker by changes in mechanical properties of the diaphragm, the microphone may be designed as lightweight as possible. For example, the microphone may have a weight that is substantially equivalent to the "missing" portion of the membrane of the loudspeaker. For instance, the membrane may have an opening, and the microphone may be disposed within the opening. The microphone may have a weight that is about the same as or less than a weight of a portion of the membrane that would occupy the opening. For example, the microphone may have a density less than a density of the membrane, and may be a lightweight microphone. In some earphones, this lightweight microphone could be an electret microphone, a MEMS (micro-electro-mechanical system) microphone, where the MEMS is based on silicon, or a condenser microphone.

MEMS may be lightweight and geometrically small. Some such MEMS microphones are manufactured and marketed, for example, by Wolfson Microelectronics (WM7xxx), Analog Devices, Akustica (AKU200x), Infineon (SMM310 product), Knowles Electronics, Memstech (MSMx), NXP Semiconductors, Sonion MEMS, AAC Acoustic Technologies and Omron. Furthermore, an amplifier or a pre-amplifier together with a MEMS device may form an electroacoustic transducer.

The microphone may be disposed or arranged concentric to an axis of the loudspeaker or a membrane of the loudspeaker. In some configurations, the microphone may be directly in or on the diaphragm. In these configurations, the diaphragm may include an opening or recess through which some portion or all of the microphone may extend. For example, a membrane of a loudspeaker could be convex with a centrally located apex. An opening or recess may be disposed in the loudspeaker, and could be at the apex. The microphone may be attached to the diaphragm such as with glue or adhesive. Electrical contacts and, if necessary, static shielding may be provided via the loudspeaker membrane itself where the membrane is at least partially metallized by vapor deposition or sputtering. The portions of the membrane that are metallized may be electrically conducting. Furthermore, electrically conducting glue may be used such as two-component epoxy resin filled with silver particles. Two-component epoxy is commercially available, for example, under the name EPO-TEK-EE129-4 or EPO-TEK H22 or EPO-TEK E4110-LV from EPOXY TECHNOLOGY, INC. in Billerica, Mass., USA. Alternatively, thin wires may be used. For example, the wires may have a diameter of about 20 μm to about 30 μm, less than about 30 μm, or less than about 20 μm.

Figure 1:
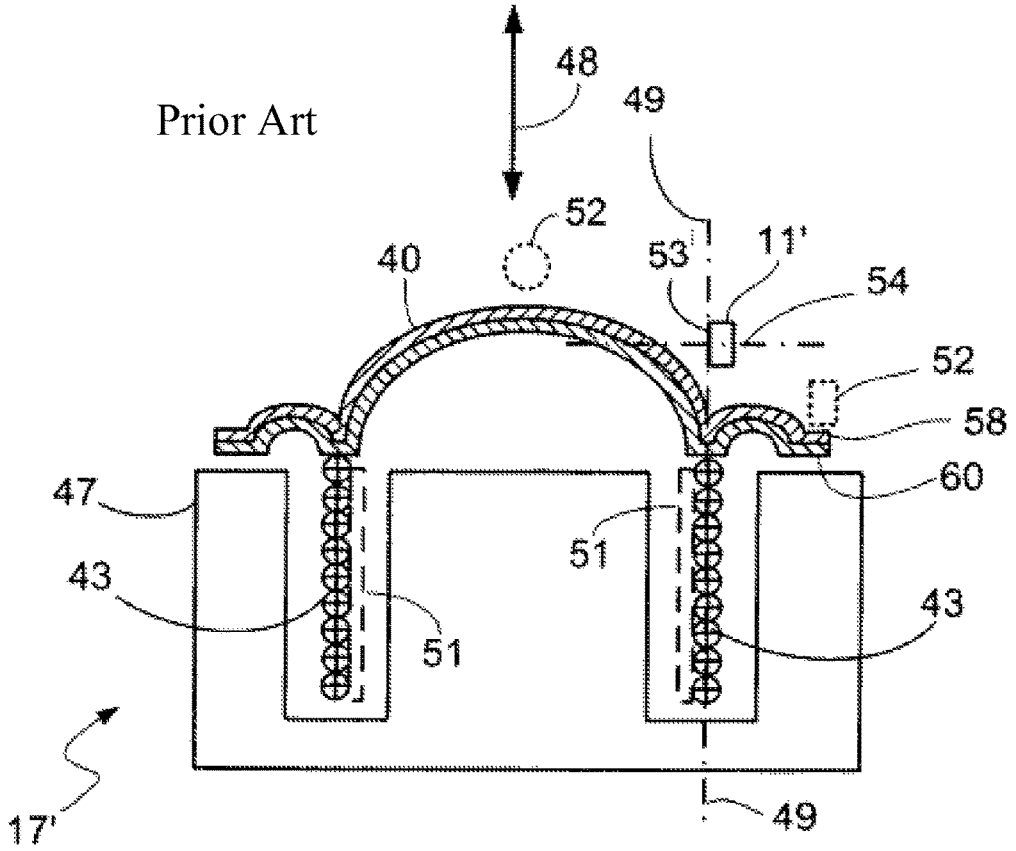
FIG. 1 shows an earphone with active noise suppression.

FIG. 1 corresponds to FIG. 2*b* of EP 1 850 632. FIG. 1 is a cross-sectional schematic of a dynamic loudspeaker. Three possible positions for a microphone are shown as positions 52 and 53. Position 52 is considered non-optimal and position 53, on the other hand, is considered good.

Figure 2:
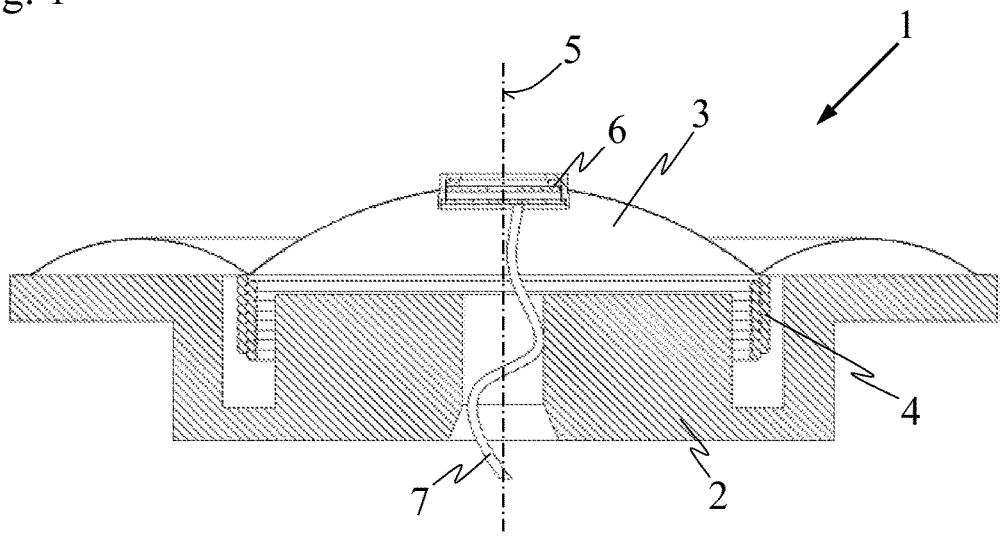
FIG. 2 is a cross-sectional view of a loudspeaker.

In contrast, FIG. 2 shows a loudspeaker 1 that includes a microphone 6 disposed in a membrane 3. The wiring of the microphone 6 occurs by means of wires 7, that are electrically connected to the microphone 6, and not via the membrane 3 itself, as with FIGS. 3 and 4 described below. The loudspeaker 1 may be an electrodynamic loudspeaker. FIG. 2 shows a loudspeaker that includes a magnet system 2, the membrane 3, and a moving coil 4 that extends into an annular groove of the magnet system 2. The coil 4 may be coupled to the membrane 3 and may be suspended within the annular groove of the magnet system 2. The coil 4 may move relative to the magnet system 2 in response to changes in electrical current though the coil 4. The wires 7 may extend away from the microphone 6 and may extend toward the magnet system 2. The wires 7 may further extend through an opening that extends through the magnet system 2 and electrically connected to an electronic circuit that is further described below. The microphone 6 may be provided concentric to an axis of symmetry 5 of loudspeaker 1 and partially or fully disposed in a recess of the membrane 3. Thus, the microphone 6 may follow the vibrations of membrane 3 and move relative to the membrane 3. The microphone 6, may be a lightweight microphone, as described above, and therefore may be an electret microphone, a microphone based on MEMS technology such as in silicon technology, or a condenser microphone.

Silicon technology may include technologies where an electret capsule may be formed from a solid material consisting of silicon monocrystal through a three-dimensional etching process. Insulating layers may be produced by oxidation or evaporation. These technologies may allow for a one-part structure (without joining). Since the technique is related to the existing semiconductor techniques, such as with integrated circuits (ICs) and microprocessors, the dimensions can be configured much smaller than the usual sizes of a conventional electret capsule. Through the use of silicon technology, sizes on the order of about 1×1×0.3 mm may be achieved.

The signal lines 7 may lead to a preamplifier, which may optionally also be provided directly on or in the microphone. Alternatively, the preamplifier may be provided in or at a location in which an impedance transducer may be situated. The preamplifier may be electrically connected to or in electrical communication with an electronic circuit to calculate the signals received by the microphone 6. The electronic circuit may process the received signals and generate control signals used to control the oscillations of membrane 3 not only to generate useful noise, but also to largely or substantially prevent or reduce the ambient noise. Alternatively, the loudspeaker 1 may be used to substantially prevent or reduce the ambient noise and not to play back a useful noise. Examples of electronic circuits that may be used in combination with a microphone and a loudspeaker to suppress ambient noise are described in EP 1 850 632, U.S. Pat. Nos. 8,077,874, 4,494,074, 4,455,675 and 5,182,774, each of which is incorporated by reference.

Figure 3:
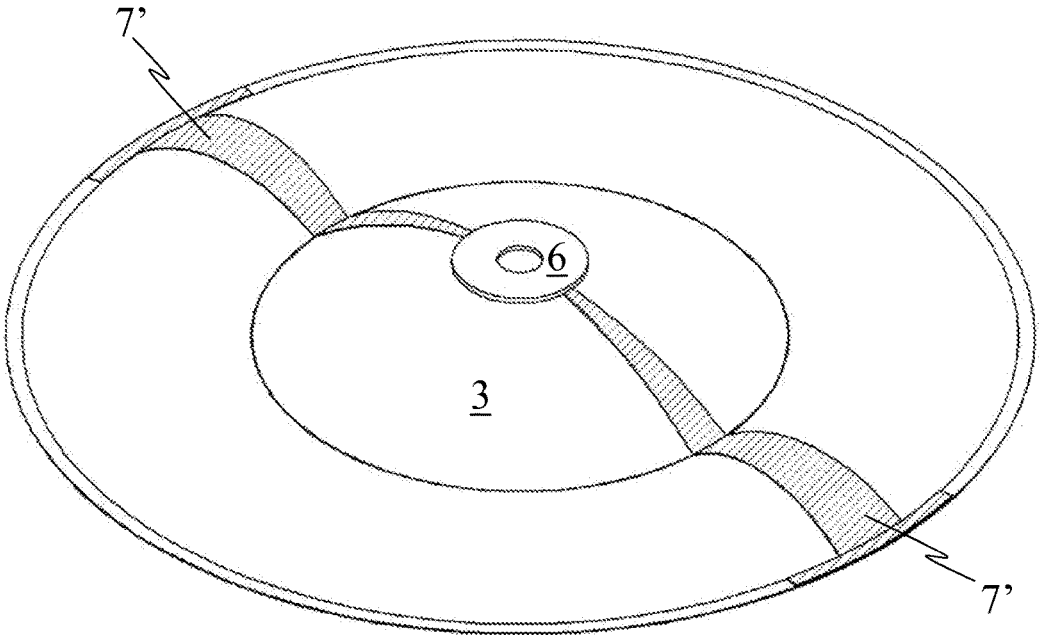
FIG. 3 is a perspective view of a loudspeaker.

FIG. 3 shows a membrane 3 of a loudspeaker in which the signal lines 7' are sputtered or deposited onto the membrane 3. The signal lines 7' may be a thin film adhered to the membrane 3. Alternatively, the signal lines 7' may be formed of an electrically conductive material such as a metal applied to the membrane 3. The weight increase of the membrane 3 as a result of the signal lines 7' may be negligible. In addition, the signal lines 7' may be aligned or positioned in a symmetrical manner about a central axis of the membrane 3 so that no or substantially no adverse effect on the oscillation mode of the membrane 3 occurs. The signal lines 7' may be in electrical contact or communication with the microphone 6 and in electrical contact or communication with electrical conductors on an outer edge of the membrane 3. Thus, the microphone 6 may be in electrical communication with the electrical conductors. The electrical conductors may be placed into electrical contact with the signal lines 7' with the aforementioned electrically conducting glue or by mechanical contacting such as with a frame that holds the membrane 3. In some configurations, different types of electrical connections between the signal lines 7' and the electrical conductors may be used in conjunction with one another. For example, one of the signal lines 7' may be electrically coupled to the electrical conductors with electrically conducting adhesive while another of the signal lines 7' may be electrically coupled to the electrical conducts by mechanical contacts with the frame.

The microphone may be fastened on or in the membrane with a glue or adhesive. If electrically conducting glue is used, the glue may be applied only in the area of the signal lines 7, 7'.

Figure 4:
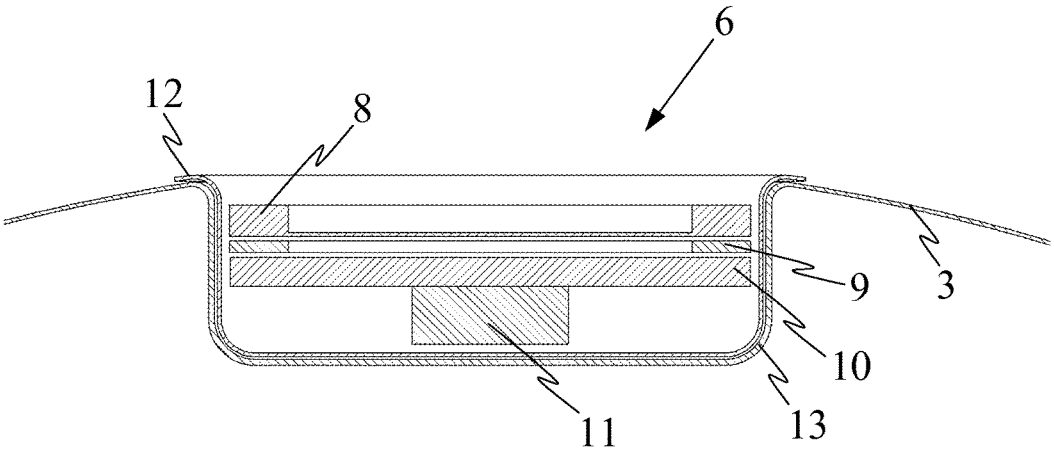
FIG. 4 is a cross-sectional view of a microphone.

FIG. 4 shows a section through a plane of symmetry of a loudspeaker that includes a microphone. In FIG. 4, the membrane 3 is shown formed with a cylindrical or cup-like recess 13. The microphone 6 may be inserted within the recess 13 and fastened within the recess 13. In some configurations, the microphone 6 may be fastened within the recess 13 with glue or other adhesive. The recess 13 may be centrally located on the membrane 3. For example, the membrane 3 may be convex or generally convex and the recess 13 may be disposed at an apex of the convex. As a result of the recess 13, the microphone 6 may be disposed between the apex and a radial edge of the membrane 13. The signal lines or coated surfaces 7' (shown in FIG. 3) may be in electrical contact or communication with a coating 12. The coating 12 may be formed of an electrically conductive material similar to that of the signal lines 7' to provide an electrical connection between the signal lines 7' and the microphone 6. The microphone 6 may include a membrane ring 8, as well as membrane, a spacer ring 9, an electrode 10 and an impedance transducer 11. Signals may be transmitted from the microphone 6 to an associated electrical circuit through the coating 12 and signal lines 7'. Similarly, signals may be received by the microphone 6 from the electrical circuit through the signal lines 7' and the coating 12.

While various embodiments have been described, it will be apparent to those of ordinary skill in the art that many more embodiments and implementations are possible and within the scope of what is describe. Accordingly, there should be no restrictions, except in light of the attached claims and their equivalents.

We claim:

1. An earphone with active suppression of ambient noise comprising:

an electrodynamic loudspeaker with a membrane;

a microphone provided in an interior of the earphone;

an electronic circuit, with which the loudspeaker and the microphone are connected by a connection line, where the microphone is directly attached to the membrane; and where the connection line of the microphone comprises a conductor track sputtered onto the membrane of the electrodynamic loudspeaker, where the membrane comprises an opening, and the microphone is disposed in the opening, and where a weight of the microphone is substantially equivalent to a weight of a portion of the membrane that would occupy the opening.

2. The earphone according to claim 1, where the microphone is arranged in a center of the membrane.

3. The earphone according to claim 1, where the microphone is an electret microphone.

4. The earphone according to claim 1, where the microphone is a microphone based on MEMS technology in silicon technology.

5. The earphone according to claim 1, where the microphone is arranged in a recess of membrane.

6. The earphone according to claim 5, where the recess comprises a coating.

7. The earphone according to claim 1, where the connection line of the microphone comprises a conductor track on the membrane.

8. The earphone according to claim 7, where the conductor track is in electrical contact with a frame of the loudspeaker.

9. The earphone according to claim 7, where the conductor track is in electrical contact with an electrically conductive glue.

10. The earphone according to claim 1, where the connection line of the microphone comprises a wire extending away from the microphone.

11. A loudspeaker system with active suppression of ambient noise comprising:

a loudspeaker comprising a diaphragm;

a microphone coupled to the diaphragm to detect interfering noise; and an electronic circuit connected to the loudspeaker and the microphone to substantially suppress the interfering noise with the loudspeaker, where the diaphragm comprises an opening, and the microphone is disposed in the opening, and where a weight of the microphone is substantially equivalent to a weight of a portion of the diaphragm that would occupy the opening.

12. The loudspeaker system according to claim 11, further comprising conductor tracks on the diaphragm to electrically connect the microphone to the electronic circuit.

13. The loudspeaker system according to claim 12, where the conductor tracks are symmetric on the diaphragm.

14. The loudspeaker system according to claim 11, where the microphone is a MEMS microphone.

15. The loudspeaker system according to claim 11, the microphone is arranged in a center of the diaphragm.

16. The loudspeaker system according to claim 11, where the electronic circuit is configured to generate phase-shifted counter-pulses on the loudspeaker to substantially suppress the interfering noise.

17. An earphone with active suppression of ambient noise comprising:

an electrodynamic loudspeaker comprising a membrane provided in an interior of the earphone;

a microphone coupled to the membrane for detecting ambient noise;

signal lines connected to the microphone; and an electronic circuit connected to the signal lines and the loudspeaker to control oscillations of the membrane to substantially suppress the ambient noise, where the membrane comprises an opening, and the microphone is disposed in the opening, and where a weight of the microphone is substantially equivalent to a weight of a portion of the membrane that would occupy the opening.

* * * * *